US007243482B2

(12) United States Patent
Bezar

(10) Patent No.: US 7,243,482 B2
(45) Date of Patent: Jul. 17, 2007

(54) GIFT WRAPPING PACKAGE AND METHOD OF USE

(76) Inventor: David Bezar, 23052H Alicia Pkwy., Suite 172, Mission Viejo, CA (US) 92692

( * ) Notice: Subject to any disclaimer, the term of this patent is extended or adjusted under 35 U.S.C. 154(b) by 0 days.

(21) Appl. No.: 11/142,181

(22) Filed: May 31, 2005

(65) Prior Publication Data

US 2006/0266668 A1 Nov. 30, 2006

(51) Int. Cl.
*B65D 73/00* (2006.01)

(52) U.S. Cl. ..... 53/468; 428/7; 428/9; 206/457

(58) Field of Classification Search ..... 428/7, 428/8, 9, 11; 206/457; 53/413, 468, 492, 53/393

See application file for complete search history.

(56) References Cited

U.S. PATENT DOCUMENTS 4,092,798 A * 6/1978 Oquita ..... 446/5
5,116,648 A * 5/1992 Martin et al. ..... 428/7
5,714,211 A * 2/1998 Zinbarg et al. ..... 428/16
6,027,437 A * 2/2000 Vercelli et al. ..... 493/85
6,277,452 B1 * 8/2001 Craig ..... 428/7
2005/0045514 A1 * 3/2005 Knotts ..... 206/457

* cited by examiner

*Primary Examiner*—David T. Fidei
(74) *Attorney, Agent, or Firm*—Russo & Duckworth

(57) ABSTRACT

A gift wrapping package is provided which furnishes enhanced ornamentation and ease of wrapping of gifts for special events. The gift wrapping package includes a housing which is retractable and expandable for forming a central cavity. In a retracted condition, gifts can be placed within the central cavity. Thereafter, the housing can be closed by expanding and rotating the housing's body portion 360 degrees until an enclosed structure is formed. In preferred embodiments, the gift wrapping package includes various ornaments and features including fanciful appendages. In addition, the gift wrapping package may include a hook or handle or other construction for enabling persons to carry a wrapped gift or to hang the gift wrapped package upon objects, such as a holiday tree.

3 Claims, 3 Drawing Sheets

GIFT WRAPPING PACKAGE AND METHOD OF USE

BACKGROUND OF THE INVENTION

The present invention relates generally to the field of gift wrapping packages. More particularly, the present invention relates to prepared packaging for receipt of gifts.

Presenting gifts has always been a way for people to show affection, goodwill or friendship at celebratory occasions and events. During special events such as birthdays, weddings, parties, baptisms, and other social events, it has been increasingly common for attendees to bring gifts which are provided in a box, bag, receptacle or other container. Typically, it is the gift giver's goal to make his or her gift as visually appealing and highly distinctive as possible in order to enhance the anticipation as to what is contained within the packaging. To this end, stores sell wrapping paper, bows, ribbons and cards for the purpose of making the packaging interesting and festive. Various packaging is available for wrapping gifts and the packaging comes in a myriad of colors, textures, themes and patterns.

Wrapping paper is the most common manner of packaging gifts. Wrapping paper consists of two-dimensional paper covered in decorative themes and color which must be cut and shaped around a box or other package storing a gift. Tape, glue or ribbon are then used to maintain the paper in a proper placement. Thereafter, various bows or additional ribbons may be used to adorn the wrapping paper. Unfortunately, the gift wrapping of packages is often a time-consuming and frustrating experience. It is difficult to properly estimate or accurately cut the correct amount of wrapping paper needed. It is also difficult to tightly and neatly attach the paper to the underlying box. To avoid this time-consuming and frustrating procedure, various gift wrapping services will wrap a package with wrapping paper for a fee. However, gift wrapping services are relatively expensive and time consuming.

Recently, decorative bags have become available as an alternative to the use of wrapping paper. These decorative bags are particularly helpful when time is an issue or when giving an irregularly shaped object that may not be sold in a box. Unfortunately, the giving of gifts in packages which are not hand-wrapped may convey a lack of caring or thought. This sentiment is the opposite to what is intended to be conveyed by the giving of a gift.

There is therefore a need for gift packaging which does not present a time-consuming and frustrating experience, while at the same time provides sufficient ornamentation and themes to convey an atmosphere of caring and consideration.

Various attempts have been made to provide decorative pre-packaged containers for gifts which provide enhance decoration compared to gift bags and which do not require the time-consuming experience of wrapping paper. For example, U.S. Patent Application 2002/0195480 naming Daniels as the inventor, describes a gift bag in which various appendages are attached to the bag to create a decorative animal. Unfortunately, the traditional shape of the gift bag and the decorative animal attachments do not particularly lend themselves to three-dimensional ornamentation.

Meanwhile, U.S. Pat. No. 6,422,388 naming McCahey as the inventor, describes various shaped containers having an openable lid. By pulling the handle, the container automatically closes. Unfortunately, the construction is relatively expensive and does not lend itself to three-dimensional decorations.

U.S. Pat. No. 5,836,508 describes a package which appears to be a traditional gift wrapped package using traditional wrapping paper. However, each portion of the box-like container is covered with traditional wrapping paper. When the box is closed, the package appears to have been wrapped by the gift giver. Unfortunately, this design is restricted to the relatively boring six-sided shape of a traditional box.

Thus, there is a significant need for an improved construction for wrapping presents that is convenient and expedient to use and still show that the giver cares enough to make the gift attractive and special.

There is also a significant need for a construction for wrapping presents which provides improved ornamentation and decoration.

Furthermore, it would be advantageous to provide a construction for wrapping presents that is inexpensive to manufacture.

SUMMARY OF THE INVENTION

Briefly, in accordance with the invention, I provide an improved gift wrapping package. The gift wrapping package includes an expandable and collapsible housing made of a foldable material. The housing expands and contracts rotatably about a central axis. In a retracted condition, the housing consists of an arcuate structure having a curved body portion having first and second ends. The arcuate body portion if expandable in an accordion-like or fan-like manner about the axis defined by the body portions' ends. This rotation and expansion continues in a rotatable manner for 360 degrees about the central axis until the body portion's edges engage to create an enclosed package. As a result of the arcuate body expanding and rotating about a central axis, a central cavity is formed for placement of gifts.

The housing may be made of numerous materials paper or fabric. Moreover, the material may be folded in various manners such as a honeycomb construction or a folded fan construction. The housing may also be constructed in an unlimited number of shapes and sizes. For example, where the housing is semi-circular in an open condition, rotation of the housing about its central axis produces a spherical closed condition. Alternatively, the housing can be constructed to produce three dimensional geometric shapes such as ellipsoid or conical, as well as fanciful shapes such as animals.

In a preferred embodiment, the gift wrapping package includes in internal liner positioned within the housing. The liner also protects the housing from any sharp edges of the gift which could otherwise tear or rip the housing.

In an additional preferred embodiment of the invention, the gift wrapping package includes a carrying device in the form of handles, hooks, loops or other means for hanging, holding or otherwise supporting the gift package. For example, the gift wrapping package of the present invention may include a traditional hook used for hanging ornaments upon a Christmas tree so that the gift may be hung upon a Christmas tree during the annual festival proceedings.

In still an additional preferred embodiment, the gift wrapping package includes a light source positioned with the package's central cavity for producing a luminescent package having even greater visual appeal.

It is therefor an object of the present invention to provide an inexpensive and simple to use construction for wrapping gifts.

It is still an additional object of the present invention to provide a construction for wrapping gifts which provides enhanced ornamentation and is more appealing to the eye than previous constructions.

These and more specific objects and advantages of the invention would be apparent to those skilled in the art from the following detailed description taken in conjunction with the drawings.

DETAILED DESCRIPTION OF THE INVENTION

Figure 1A:
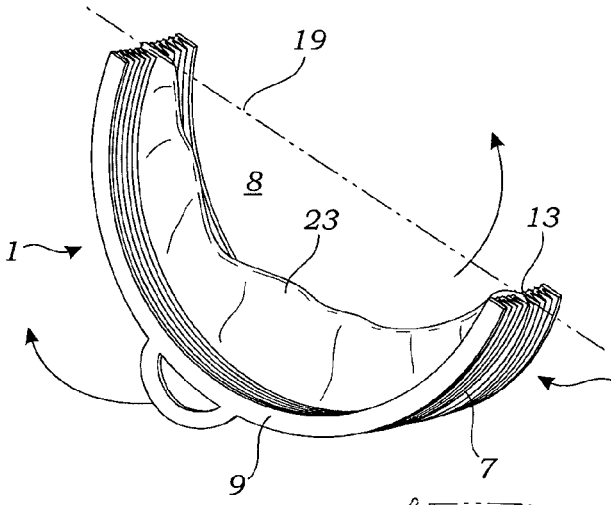
FIG. 1A is a perspective view of a first embodiment of the gift wrapping package of the present invention in an open condition producing a substantially spherical package.

While the present invention is susceptible of embodiment in various forms, as shown in the Figures and will hereinafter be described the presently preferred embodiments of the invention with the understanding that the present disclosure is to be considered as an exemplification of the invention and it is not intended to limit the invention to the specific embodiments illustrated.

With reference to the Figures, the gift wrapping package 1 of the present invention includes a housing 5 forming a central cavity 21. The housing includes an arcuate body portion 7 which is expandable and retractable by rotating one edge 9 of the housing about a central axis 19. In a retracted condition, the housing's body 7 is substantially planer includes an arcuate construction for forming one or more recesses 8. In a retracted condition, the body further includes edges 9 as well as first and second ends 13.

Figure 1B:
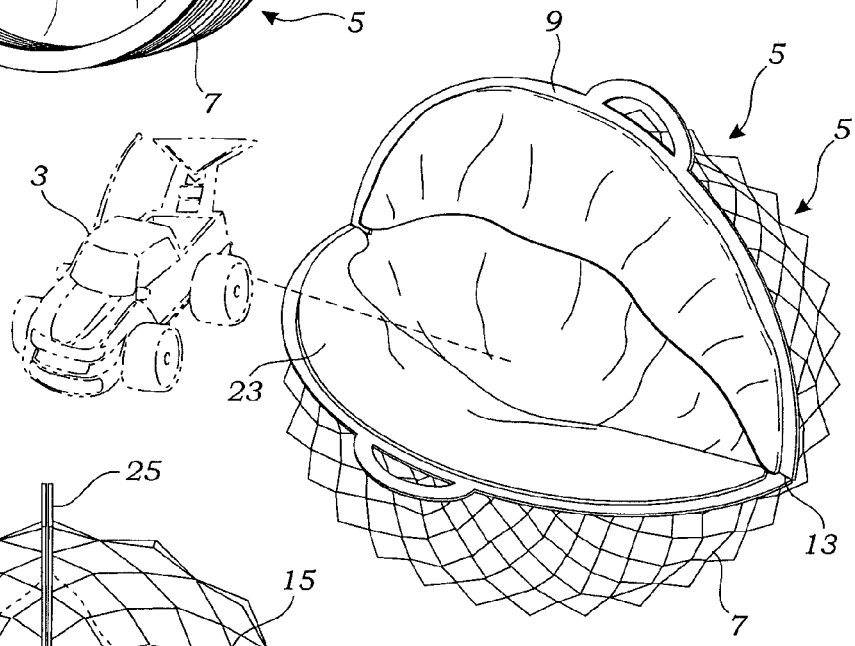
FIG. 1B is a perspective view of the gift wrapping package illustrated in FIG. 1A wherein the housing is moving to a close condition.

Of importance, the housings' body 7 is expandable from a retracted condition for providing a cavernous structure including a central cavity 21. As shown in FIGS. 1A, 2A, 3A and 4A, when the housing is in a retracted "open" condition, the housing includes first and second arcuate edges 9 terminating at their ends 13. The housing expands by forcing the housings' edges 9 away from each other while at the same time rotating about a central axis 19. As the edges are rotated relative to one another approximately 360 degrees, the body portion expands until the edges 9 engage to form an enclosed housing. As shown in FIG. 1B, gifts may be introduced into the gift wrapping packages' central cavity 21 when the housing is in an open condition or partially open condition. Thereafter, the housings' body is expanded until the body's edges engage to form an enclosed structure, such as shown in FIGS. 1C, 2B, 3B and 4B.

The housing 5 may be maintained in a closed condition using various known structures and materials such as tape, glue, snaps, string ties, ribbons, etc. However, as shown in the FIGS. 2A and 3A, preferably the gift wrapping package utilizes a hook and pile fastener such as velcro for maintaining the housing in a closed condition.

Furthermore, the housing may be constructed of any flexible or expandable material. However, in a preferred embodiment, the housings' body 7 is made of a lightweight paper including a plurality of fold-lines allowing the housing to expand and retract in a fan-like manner. Moreover, where rigidity of the housing is important, the housing may include one or more wire ribs for stiffening and supporting the housing. The ribs may be positioned interior, exterior or within the housing's body 7. Meanwhile, it is preferred that the edges 9 be constructed of an inexpensive lightweight material of greater strength and stiffness than the housing's body portion. To this end, it is preferred that the housings' edges 9 be constructed of cardboard or other similar stiff paper material.

Figure 1C:
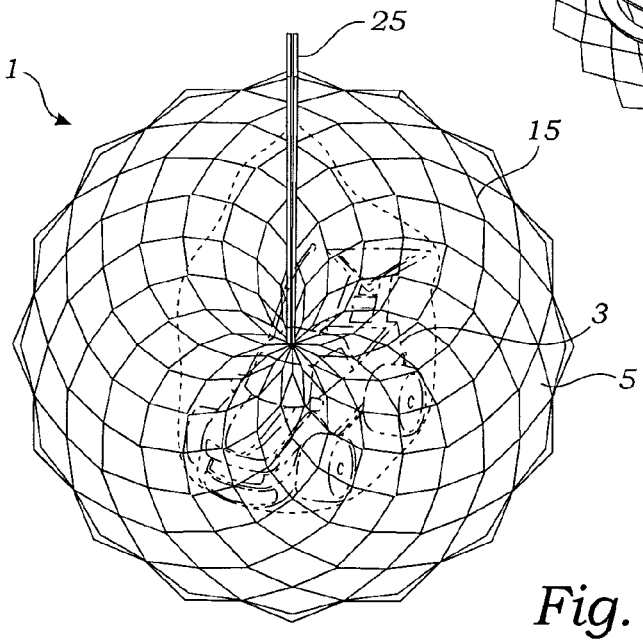
FIG. 1C is a perspective view illustrating the gift wrapping package of FIG. 1A wherein the housing is in a closed condition.
Figure 2A:
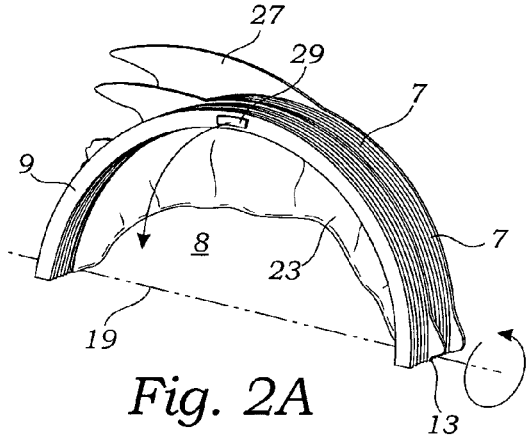
FIG. 2A is a perspective view illustrating a second embodiment of the gift wrapping package of the present invention with the housing in an open condition for producing a package depicting a fish.
Figure 2B:
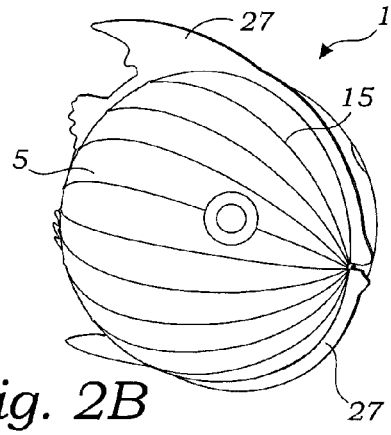
FIG. 2B is a perspective view illustrating the gift wrapping package of FIG. 2A wherein the housing is in a closed condition.
Figure 3A:
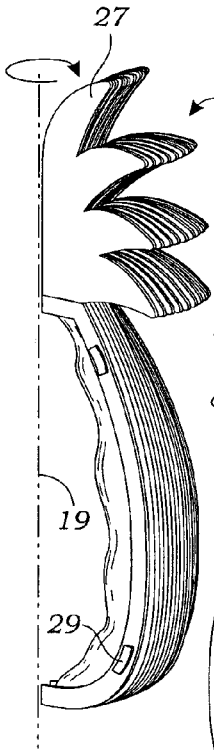
FIG. 3A is a third embodiment of the gift wrapping package of the present invention wherein the housing is in a open condition.
Figure 3B:
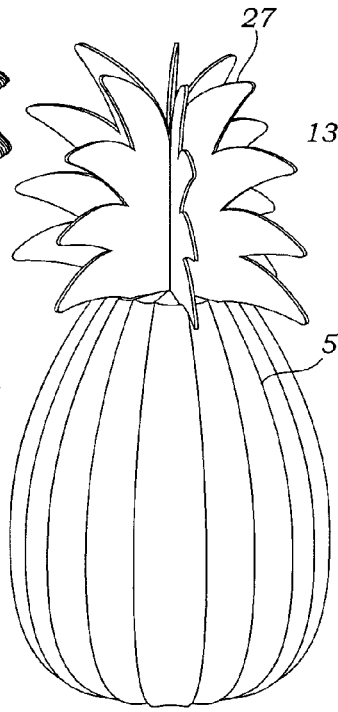
FIG. 3B is a perspective view illustrating the gift wrapping package shown in FIG. 3A wherein the housing is in a closed condition and depicts a pineapple.
Figure 4A:
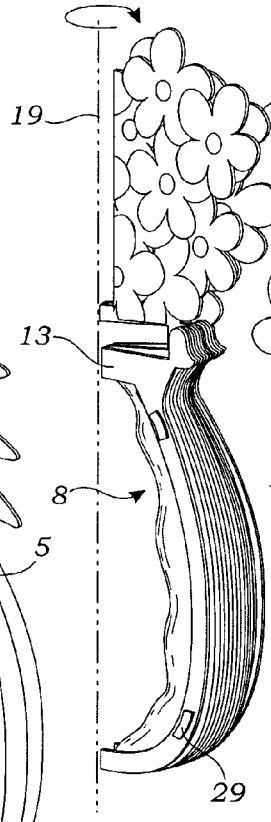
FIG. 4A is a fourth embodiment of the gift wrapping package of the present invention wherein the housing is in a open condition.
Figure 4B:
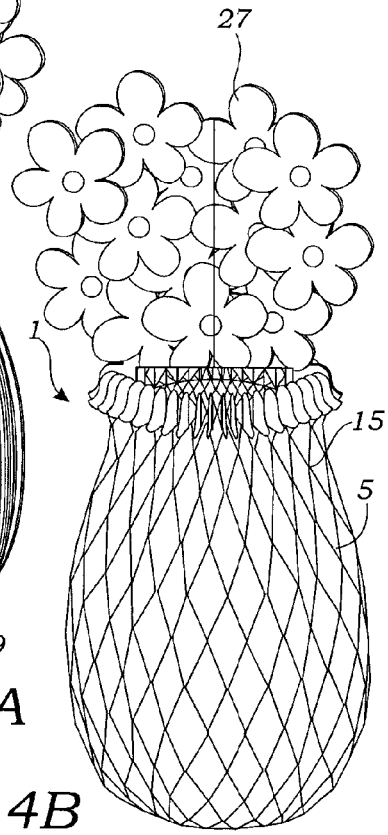
FIG. 4B is a perspective view illustrating the gift wrapping package shown in FIG. 4A wherein the housing is in a closed condition and depicts a flower vase.

In the alternative to a fan-like structure shown in FIGS. 2A and 2B, the housings' body portion may also be constructed of an expanded honeycomb structure, such as shown in FIGS. 3 and 4. Again, it is preferred the body portion be constructed of a lightweight, flexible paper material while the housing's edges be made of a stiffer cardboard material. Where the body is constructed of a honeycomb material, in order to obstruct the view of the gift 3 within the housing, it is preferred that the gift wrapping package further include a liner 23 as shown in FIG. 1B and FIG. 1C. In addition to obstructing the view of the gift 3, the liner 23 provides additional structure and protection for the gift wrapping package's body 7.

Various modifications of the gift wrapping packages' structure may be made to create an unlimited number of shapes and sizes. For example, as shown in FIGS. 1A–1C, the gift wrapping packages' body may be shaped as a semi-circle when in a retracted condition to produce a spherical housing construction. Alternatively, as shown in FIG. 3 and FIG. 4, the gift wrapping package's housing may include elongate shapes for producing various fanciful and ornamental structures.

The gift wrapping package may also be constructed to include various ornamental elements. For example, preferably the packaging is adorned with various colors, symbols or designs to provide a fanciful appearance. In addition, as shown in FIGS. 2–4, the cover may be adorned with various decorative elements such as appendages 27 to form fanciful animals, such a decorative fish shown in FIG. 2, or other decorative constructions, such as a pineapple or vase shown in FIGS. 3 and 4 respectively. As still an additional example, the appendages may be constructed to resemble animal appendages, such as heads, feet, arms, legs, hands, fins, tentacles, hands, etc., so as to support a curved housing upon a flat surface. Similarly, a flat base may be appended to the bottom of an arcuate gift wrapping package, such as the packages 1 shown in FIGS. 1–4, to support the gift wrapping package on a flat surface.

Figure 5:
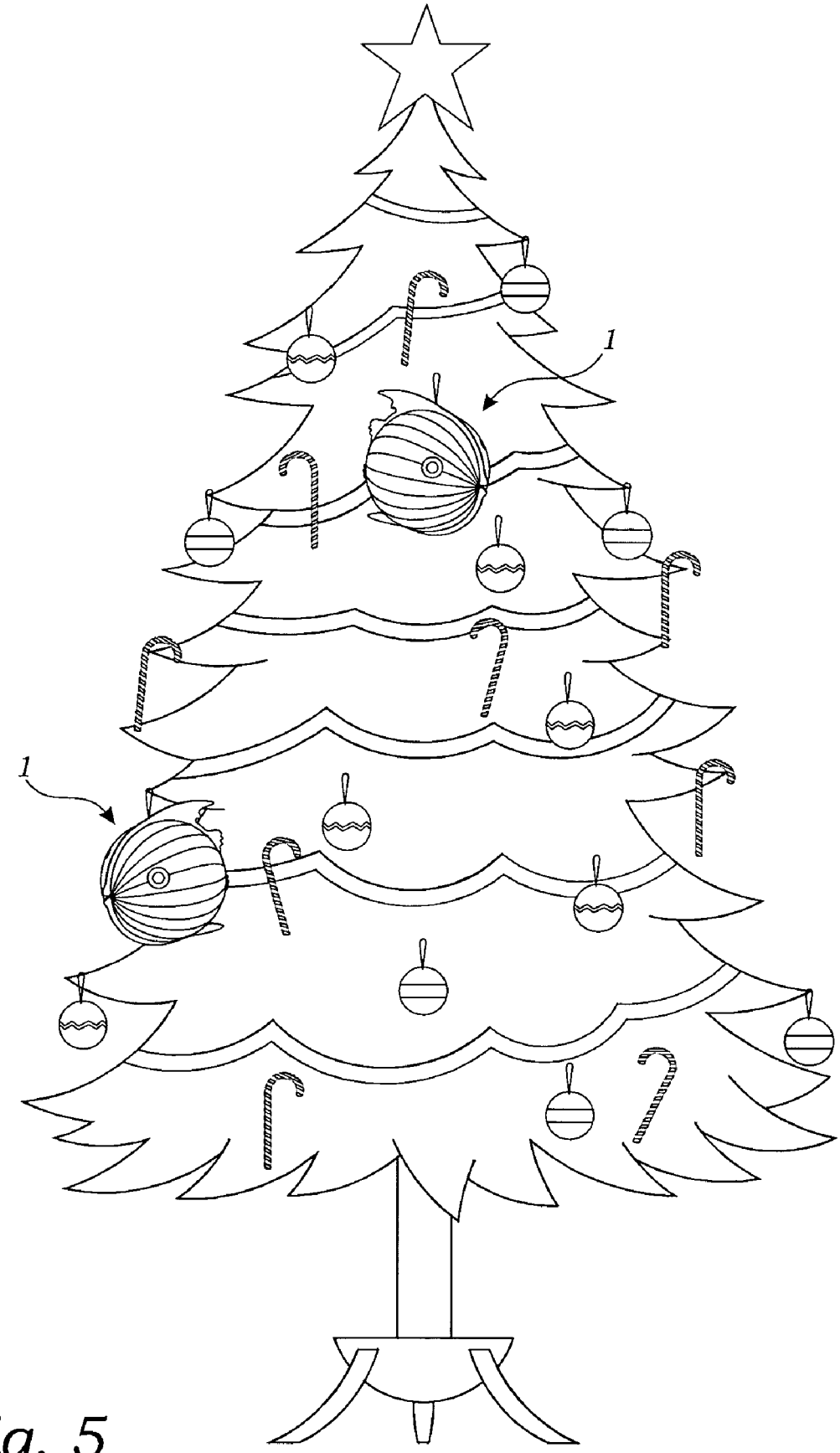
FIG. 5 is a perspective view illustrating a gift wrapping package of the present invention hung upon a holiday tree.

In still additional preferred embodiments, the gift wrapping package may include constructions for assisting a person to carry or hang the gift being packaged. To this end, the package may include carrying device 5 such as a handle, loop of hook which affixes to the housing. In addition to using the handle, loop or hook or other similar construction for use in carrying a wrapped gift, the carrying device can be used to hang the wrapped gift on other objects, such as on the branches of a Christmas tree. As shown in FIG. 5, the gift wrapping package thereby functions as a Christmas tree ornament for enhancing the visual appeal of the tree and increasing the anticipation of a present within the package.

In still additional embodiments of the invention, the gift wrapping package may include a light (not shown) which is positioned within the housing's central cavity 21. Since the housing is preferably made of a lightweight material such as paper, which is typically semi-translucent, the light source creates an illuminated gift wrapping package having even greater visual appeal. Also not shown in the Figures, the housing may be constructed with an opening for receipt of one or more lights hung on a Christmas tree. In use, the gift wrapping package of the present invention can be hung upon a tree with the light source projected through the opening toward the housing's central cavity to illuminate the interior of the housing and provide illumination through the housing's semi-translucent structure.

Although particular preferred embodiments of the invention have been described herein, it is to be understood that variations may be made in the construction, materials and shape of the gift wrapping package without departing from the spirit and scope of the invention. Having described the invention in such terms to enable those skilled in the art to make and use it, and having identified the presently preferred embodiments thereof,

I claim:

1. A method of wrapping and giving a gift package comprising the steps of:

providing a wrapping package including an expandable housing, the expandable housing including a first arcuate edge having a first end and second end and a second arcuate edge having a first end and a second end, the first arcuate edge's first end engaging the second arcuate edge's first end and the first arcuate edge's second end engaging the second arcuate edge's second end, the housing further including a retractable and expandable body portion engaging the first arcuate edge and the second arcuate edge, the first and second arcuate ends of the first and second arcuate edges defining a central axis about which the second arcuate edge rotates relative to the first arcuate edge, the second arcuate edge rotating substantially 360° relative to the first arcuate edge from a substantially flat retracted open condition wherein the first and second arcuate edges form an interior recess to an expanded closed condition wherein the body portion expands from a retracted condition to an expanded condition to form an enclosed central cavity, said wrapping package further including a liner positioned adjacent to the body portion and interior to the central cavity;

maintaining the housing within an open condition;

positioning a removable gift within the interior recess;

placing the housing within a closed condition by rotating the second arcuate edge substantially 360° relative to the first arcuate edge to position the removable gift within the central cavity;

giving the wrapped gift to a recipient at a celebratory event, and retrieving the gift by the recipient by opening the housing and removing the gift from the wrapping package's central cavity.

2. The method of wrapping and giving a gift package of claim 1 further comprising the steps of:

providing the wrapping package with an attachment means for hanging the wrapping package upon a festival tree; and hanging the wrapping package and gift upon a festival tree.

3. The method of wrapping and giving a gift package of claim 1 further comprising the steps of:

providing said wrapping package with a handle attached to the expandable housing.

* * * * *